US007278595B2

(12) United States Patent
Itoh et al.

(10) Patent No.: US 7,278,595 B2
(45) Date of Patent: Oct. 9, 2007

(54) PARTICLE FEED APPARATUS FOR JET MILL

(75) Inventors: Hitoshi Itoh, Tokyo (JP); Hiroki Tanaka, Tokyo (JP)

(73) Assignee: Seishin Enterprise Co., Ltd., Tokyo (JP)

( * ) Notice: Subject to any disclaimer, the term of this patent is extended or adjusted under 35 U.S.C. 154(b) by 607 days.

(21) Appl. No.: 10/478,605

(22) PCT Filed: Aug. 20, 2002

(86) PCT No.: PCT/JP02/08375

§ 371 (c)(1),
(2), (4) Date: Jun. 10, 2004

(87) PCT Pub. No.: WO03/020428

PCT Pub. Date: Mar. 13, 2003

(65) Prior Publication Data

US 2004/0211849 A1 Oct. 28, 2004

(30) Foreign Application Priority Data

Sep. 3, 2001 (JP) ..... 2001-265418

(51) Int. Cl.
*B02C 19/06* (2006.01)

(52) U.S. Cl. ..... 241/39; 241/5

(58) Field of Classification Search ..... 241/5, 241/39

See application file for complete search history.

(56) References Cited

U.S. PATENT DOCUMENTS 2,515,541 A * 7/1950 Yellott ..... 241/39
2,636,688 A * 4/1953 Singh ..... 241/1
4,917,309 A * 4/1990 Zander et al. ..... 241/5
5,598,979 A * 2/1997 Rowley, Jr. ..... 241/5
6,786,437 B2 * 9/2004 Ribardi ..... 241/5

FOREIGN PATENT DOCUMENTS

| | | |
|---|---|---|
| EP | 276742 A2 | 8/1988 |
| JP | 53725/1983 | 4/1983 |
| JP | 61-21731 | 2/1986 |
| JP | 62-016926 | 1/1987 |
| JP | 110844/1989 | 7/1989 |
| JP | 9-10620 | 1/1997 |
| JP | 63-194750 | 8/1998 |

* cited by examiner

*Primary Examiner*—Bena Miller
(74) *Attorney, Agent, or Firm*—Carrier, Blackman & Associates, P.C.; Joseph P. Carrier; William D. Blackman

(57) ABSTRACT

A particle feed apparatus is combined with a jet mill and has a particle feeder for feeding particles to an air injector that injects particles together with particle carrying air into the jet mill. The particle feed apparatus is a closed structure isolated from the environment. The use of the closed particle feed apparatus prevents the backflow of dust-loaded air that occurs in a milling system formed by combining a jet mill and an open particle feed apparatus. The use of the closed particle feed apparatus improves the working environment, enhances the milling ability of the jet mill and facilitates operations.

10 Claims, 11 Drawing Sheets

Fig.5A

[CLOSED MILLING SYSTEM]

| FEED RATE (kg/hr) | SUPPLY PRESSURE AT THE PUSH NOZZLE (MPa) | SUPPLY PRESSURE AT THE PULVERIZING NOZZLES (MPa) | MEAN PARTICLE SIZE (μm) | STATIC PRESSURE IN THE EQUALIZER PIPE (kPa) |
|---|---|---|---|---|
| 0.8 | 0.60 | 0.60 | 3.48 | 85 |
| 2.2 | 0.60 | 0.60 | 3.82 | 59 |
| 4.5 | 0.60 | 0.60 | 4.11 | 26 |
| 9.0 | 0.60 | 0.60 | 4.42 | 22 |
| 17.8 | 0.60 | 0.60 | 4.63 | 16 |
| 21.7 | 0.60 | 0.60 | 4.99 | 15 |

Fig.5B

[OPEN MILLING SYSTEM]

| FEED RATE (kg/hr) | SUPPLY PRESSURE AT THE PUSH NOZZLE (MPa) | SUPPLY PRESSURE AT THE PULVERIZING NOZZLES (MPa) | MEAN PARTICLE SIZE (μm) |
|---|---|---|---|
| 0.8 | 0.60 | 0.33 | 4.36 |
| 2.2 | 0.60 | 0.37 | 4.54 |
| 4.5 | 0.60 | 0.42 | 4.58 |
| 9.0 | 0.60 | 0.55 | 4.67 |
| 17.8 | 0.60 | 0.57 | 4.68 |
| 21.7 | 0.60 | 0.60 | 5.19 |

Fig.7A

[NOISE LEVEL WHEN THE JET MILL IS NOT LOADED]

| TYPE OF THE MILLING SYSTEM / DISTANCE FROM THE CENTER OF THE JET MILL | OPEN (dB) | CLOSED (dB) |
|---|---|---|
| 1m | 94 | 80 |
| 3m | 91 | 78 |

Fig.7B

[NOISE LEVEL WHEN THE JET MILL IS LOADED]

| TYPE OF THE MILLING SYSTEM / DISTANCE FROM THE CENTER OF THE JET MILL | OPEN (dB) | CLOSED (dB) |
|---|---|---|
| 1m | 92 | 78 |
| 3m | 88 | 76 |

PRIOR ART

PARTICLE FEED APPARATUS FOR JET MILL

TECHNICAL FIELD

The present invention relates to a particle feed apparatus for feeding particles to a jet mill that is used as a pulverizer or a crusher for breaking down solid lumps used in a wide variety of fields of materials including medicines, agricultural chemicals, paints, resins, cosmetic materials, mineral materials and ceramic materials for fine ceramics.,

BACKGROUND ART

The jet mill jets compressed air or superheated steam of a pressure several times the atmospheric pressure, or a high-pressure gas in jet streams through a jet nozzle to accelerate particles to pulverize the particles by collision or abrasion between the accelerated particles or by collision of the accelerated particles against a collision plate.

The jet mill is a dry pulverizer capable of pulverizing particles into finely pulverized product having a mean particle size of several micrometers and is suitable for pulverizing heat-susceptible substances.

There are some types of jet mills including swirling-current jet mills, opposed nozzle jet mills, fluidized bed jet mills and impactor jet mills. Those jet mills, irrespective of type, are provided with a particle feed apparatus for feeding particles into a fluid jet.

FIG. 11 is a view of assistance in explaining the operation of a conventional horizontal swirling-current jet mill provided with ancillary devices for pulverizing particles.

Referring to FIG. 11, a jet mill 01 has a horizontal swirl casing. Compressed air is jetted through a plurality of pulverizing nozzles 02 into the swirl casing to produce a swirling current in the swirl casing. A ring header pipe 03 holding compressed air is connected to the plurality of pulverizing nozzles 02 to supply compressed air to the pulverizing nozzles 02. A compressor 05 is connected through a pressure regulator 06 and a valve 07 to the ring header pipe 03 to supply compressed air to the ring header pipe 03.

An air injector 04 discharges a solid-gas mixed fluid containing carrying air and particles into the horizontal swirling casing of the jet mill 01.

The compressor 05 is connected through a pressure regulator 010 and a valve 011 to the air injector 04 to supply compressed air to the air injector 04. The compressed air supplied to the air injector 04 is accelerated and jetted as carrying air through a venturi nozzle, not shown, into the jet mill.

The air injector 04 is provided with a feed hopper 04*a*. A feeder 015 feeds particles through a connecting chute 016 at a regulated feed rate into the feed hopper 04*a*.

The feeder 015 has a particle hopper 015*a* opening into the atmosphere, and the connecting chute 016 has a sidewall provided with an opening 016*a*. Thus, the feeder 015 and the connecting chute 016 form an open particle feed apparatus.

In the jet mill 01 combined with those ancillary devices, the venturi nozzle of the air injector 04 accelerates and discharges carrying air into the swirl casing of the jet mill 01 to produce a partial vacuum on its upstream side. Consequently, air around the jet mill 01 is sucked as secondary air through the opening 016*a* of the connecting chute 016 together with the particles fed at a fixed feed rate by the feeder 015. The secondary air and the particles are mixed with carrying air to produce a solid-gas mixture, and the solid-gas mixed fluid is accelerated and introduced into the jet mill 01.

The particles accelerated by the venturi nozzle of the air injector 04 and discharged into the swirling casing are pulverized by collision and abrasion between the particles and collision against, and abrasion by the wall of the swirl casing.

The collision speed of the particles carried by the carrying air and colliding against each other must be high to enhance the pulverizing ability of the swirl jet mill. Generally, the horizontal swirl jet mill is designed and fabricated so as to produce a high-speed swirling-current.

The static pressure of the swirling current swirling at a high velocity in the jet mill is high. If the static pressure of the swirling current exceeds the vacuum (negative pressure) produced by the air injector, the air injector is unable to blow particles into the swirling current and backflow occurs.

Therefore the jet mill 01 must be operated by the following procedure to avoid backflow.

First, the valve 011 connected to the air injector 04 is fully opened and compressed air is supplied to the air injector 04.

Then, the valve 07 placed in the line connected to the pulverizing nozzles 02 is opened gradually to increase the pressure gradually from zero (gage pressure). The opening operation for opening the valve 07 is stopped when the pressure of compressed air at the pulverizing nozzles 02 has reached a value that produces a swirling current of a static pressure not exceeding the vacuum in the air injector 04 in the jet mill 01.

If the static pressure of the swirling current exceeds the vacuum in the air injector 04 and backflow occurs in the feed hopper 04*a* of the air injector 04, the opening of the valve 07 is reduced slightly to reduce the pressure of compressed air at the pulverizing nozzles 02 to a level that does not cause backflow.

In this state, a swirling current is produced in the jet mill according to the pressure at the pulverizing nozzle 02. Then, secondary air sucked through the opening 016*a* of the connecting chute 016 is blown together with the carrying air through the venturi nozzle into the jet mill.

Then, the feeder 015 starts feeding particles at a fixed feed rate. The particles and the secondary air are mixed with the carrying air to produce a solid-gas mixed fluid, and the solid-gas mixed fluid is blown into the swirling current produced in the jet mill.

The particles introduced into the swirling current collide against each other and are pulverized. When the particles are thus introduced into the swirling current, the velocity of the thus loaded swirling current decreases and the static pressure of the swirling current drops below the static pressure of the unloaded swirling current.

It takes time in the range of several minutes to ten-odd minutes until a stable swirling current having a fixed particle holdup is produced in the jet mill while particles are fed at the fixed feed rate. The existing state is maintained for that time.

After a stable swirling current has been produced, the valve 07 connected to the pulverizing nozzles 02 is opened gradually to increase the pressure at the pulverizing nozzles gradually so that the velocity of the swirling current increases. Consequently, the milling effect of the swirling current increases for the finer pulverization of the particles.

The static pressure of the swirling current increases in proportion to the velocity of the swirling current. Increase of the opening of the valve 07 is stopped immediately before the static pressure of the swirling current of the solid-gas mixed fluid containing particles exceeds the vacuum of the air injector 04 and the secondary air is sucked at a low rate through the opening 016*a* of the connecting chute 016 while the jet mill is in operation.

The backflow of powder-laded air occurs when the static pressure of the swirling current of the solid-gas mixed fluid exceeds the vacuum of the air injector 04. Therefore, the operator empirically determines the time to stop the operation for opening the valve 07 immediately before the static pressure exceeds the vacuum.

Thus, the valves need to be operated by many sequential steps to prevent the backflow of powder-loaded air due to the increase of the static pressure of the swirling current beyond the vacuum produced by the air injector, and hence the jet mill is very difficult to operate.

Although it is possible to measure the static pressure at which backflow occurs of the swirling current of air not loaded with particles, the static pressure of the swirling current of the solid-gas mixed fluid cannot be measured while the particles are fed at an optional feed rate. Therefore, the difference between the static pressure of the swirling current immediately after the start of feeding the particles and the static pressure at which backflow occurs cannot previously be determined. The operator needs to visually watch the opening 016*a* of the connecting chute 016 while the operator is operating the valve 07 for the finer pulverization of the particles and needs to reduce the opening of the valve 07 slightly upon the detection of any indication of backflow to prevent backflow and to set the valve at that opening. Thus, the conventional jet mill is operated by such an instable operating method depending on the visual detection of the operating condition and the operator's experience The static pressure of the swirling current varies in a wide range in a transient state between the start of operation of the jet mill and the achievement of the predetermined particle holdup in the swirling current. Therefore, the opening of the valve 07 needs to be adjusted repeatedly so that the highest possible static pressure of the swirling current that does not cause backflow is maintained. Thus, the operation of the valve 07 is troublesome.

Even if the static pressure of the swirling current is stabilized at a level slightly below the static pressure at which backflow occurs after the achievement of the particle holdup, the load on the swirling current decreases if the feed of particles by the feeder 015 is interrupted or the feed rate is reduced by some cause. Consequently, the velocity of the swirling current rises, the static pressure of the swirling current rises accordingly, and, in some cases, the static pressure increases beyond the vacuum in the air injector 04 causing backflow.

If backflow occurs, particles and powder are blown out and through the opening 016*a* of the connecting chute 016 and are scattered in and contaminate the workshop, which is detrimental to the health management of the operators. Thus, backflow is a serious problem to be solved.

Since the operation of the jet mill must be stopped and materials are wasted if backflow occurs, the pulverizing process must continuously or frequently be monitored to see if there is any indications of backflow. Such a pulverizing process is inefficient and practically disadvantageous.

A pulverizing method may feed particles at a low feed rate to control the particle size in pulverizing particles by a jet mill. When the feed rate is reduced, load on the swirling current decreases. Consequently, the velocity of the swirling current increases, the static pressure of the swirling current increases accordingly and, eventually, backflow is liable to occur.

Backflow can be prevented only by controlling the pressure of the compressed air at the pulverizing nozzles 02 so that the static pressure of the swirling current may not exceed the vacuum in the air injector 04.

It is one of original pulverizing methods using a jet mill that maintains a high-velocity swirling current and feeds particles into the swirling current at a low feed rate so that the particle concentration of the swirling current is small and load on the jet mill is small.

However, the pressure of compressed air at the pulverizing nozzles inevitably needs to be reduced because backflow is liable to occur if the velocity of the swirling current is high. Thus, the conventional pulverizing method is unable to achieve pulverization satisfactorily under pulverizing conditions requiring feeding particles at a low feed rate and producing a high-velocity swirling current.

The present invention has been made in view of those problems and it is therefore an object of the present invention to provide a particle feed apparatus for feeding particles to a jet mill, capable of preventing backflow, improving the condition of the working environment, and enabling the jet mill to fully exercise its pulverizing ability, and facilitating the operation of the jet mill.

DISCLOSURE OF THE INVENTION

A particle feed apparatus according to a first aspect of the present invention for feeding particles to a jet mill comprises a particle feed system including a particle feeder; wherein the particle feed system is a closed structure isolated from the environment.

Since the particle feed apparatus is a closed structure isolated from the environment, the backflow of powder-loaded air can be prevented with the interior of the particle feed apparatus kept at a pressure equal to the remainder of subtraction of a vacuum in an air injector from a static pressure in a mill. Thus, the condition of the working environment is improved, pulverizing operations are simplified, the operability of the mill is improved and the operator does not need empirical skill. The pulverizing ability of the mill can be enhanced by increasing the static pressure in the mill.

A particle feed apparatus according to a second aspect of the present invention for feeding particles to a jet mill comprises: a particle hopper; a particle feeder for feeding particles contained in the particle hopper; and a connecting chute connecting the particle feeder to an air injector included in the jet mill to feed particles into the air injector; wherein the particle hopper, the particle feeder and the connecting chute are assembled in a closed structure and define closed spaces connected to the interior of the air injector and isolated from the environment, respectively.

Since the particle hopper, the particle feeder and the connecting chute are closed structures respectively defining closed spaces connected to the interior of the air injector and isolated from the environment, the interior of a particle feed system is kept at a pressure equal to the remainder of subtraction of a vacuum in the air injector from a static pressure in the mill, and thereby the backflow of powder-loaded air can be prevented. Consequently, the condition of the working environment is improved, pulverizing operations are simplified, the operability of the mill is improved and the operator does not need empirical skill. The pulverizing ability of the mill can be enhanced by increasing the static pressure in the mill.

In the particle feed apparatus for a jet mill according to the present invention, the respective interiors of the particle hopper and the particle feeder may be connected by an equalizer pipe.

When the respective interiors of the particle hopper and the particle feeder are connected by the equalizer pipe, the respective pressures in the interiors are equalized and thereby the flow of particles into the air injector can be avoided.

Preferably, the particle feeder is a rotary feed mechanism provided with partition plates. The rotary feed mechanism provided with partition plates separates the particle hopper from the downstream side of the feeder by the partition plate while the feeder is at a standstill and thereby the flow of particles into the air injector can be avoided.

The undesired flow of particles can perfectly be prevented regardless of the fluidity of the particles by using the rotary feed mechanism in combination with the equalizer pipe.

The rotary feed mechanism with partition plates may include a turntable provided in its peripheral part with a plurality of particle feed pockets separated from each other, a turntable case accommodating the turntable, and a rotative drive shaft for driving the turntable for rotation.

The turntable is disposed between an upper plate and a lower plate so as to rotate in sliding contact with the upper and the lower plate, the upper and the lower plates are provided in their peripheral parts with a cutout serving as a particle inlet and a cutout serving as a particle outlet, respectively, and the cutouts are at vertically non-coinciding positions.

Preferably, the air injector is provided with a feed hopper, and the connecting chute is connected in an airtight fashion to the feed hopper. The particle hopper is provided with a normally closed hatch. Thus, the particle feed system is a perfectly closed structure defining a space isolated from the environment.

BRIEF DESCRIPTION OF THE DRAWINGS

FIGS. 5A and 5B are tables showing the results of tests of a the milling ability of jet mills combined with the particle feed apparatus of the present invention and a conventional particle feed apparatus, respectively;

FIGS. 7A and 7B show measured noise levels of sound generated when the particle feed apparatus of the present invention is used and when a conventional particle feed apparatus is used, respectively;

BEST MODE FOR CARRYING OUT THE INVENTION

A particle feed apparatus in a preferred embodiment according to the present invention will be described with reference to FIGS. 1 to 7.

Figure 1:
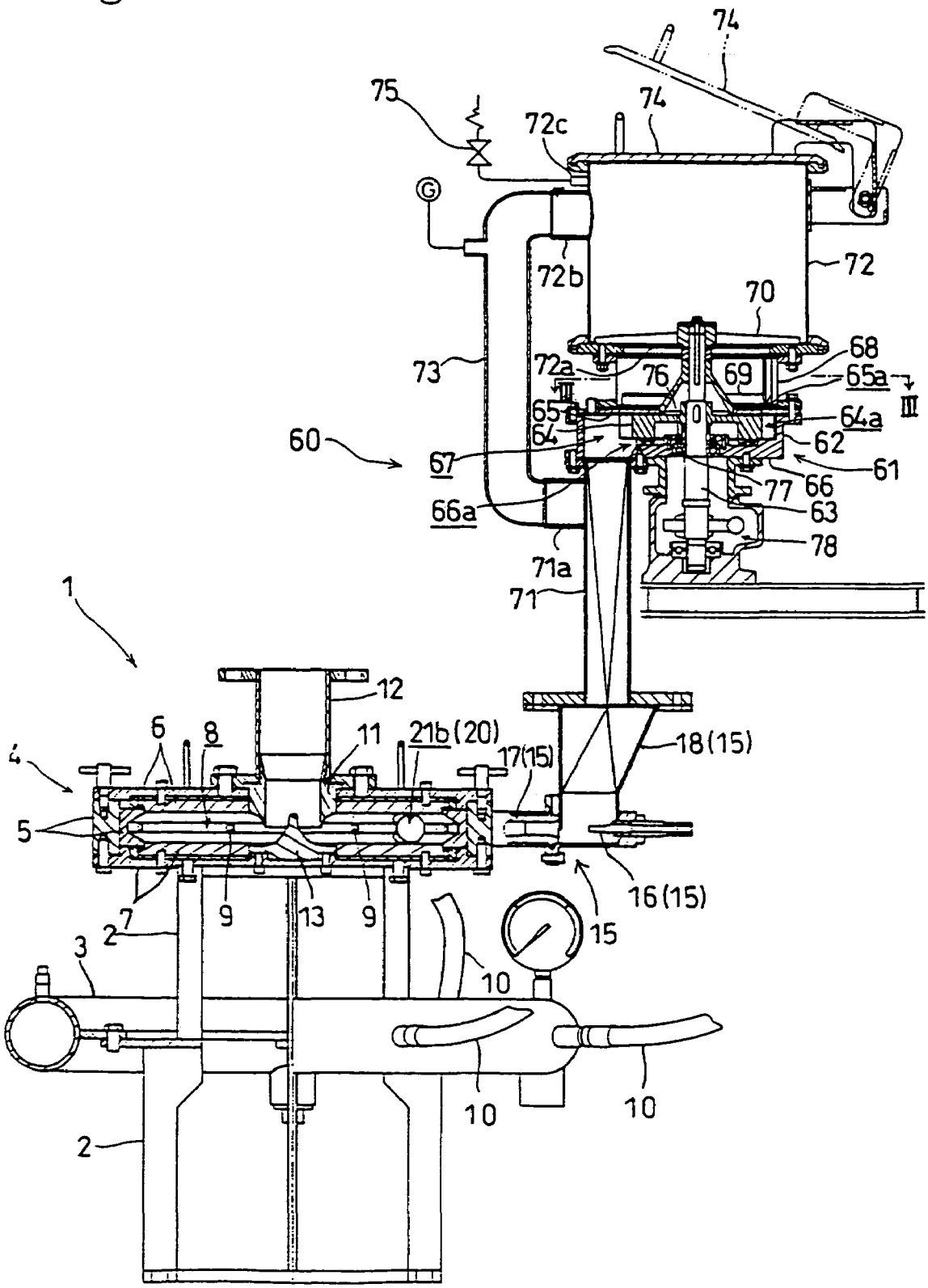
FIG. 1 is partly sectional view of a jet mill combined with a particle feed apparatus in a preferred embodiment of the present invention.

FIG. 1 shows a particle feed apparatus 60 in a preferred embodiment of the present invention combined with a horizontal swirling current type jet mill 1.

Figure 2:
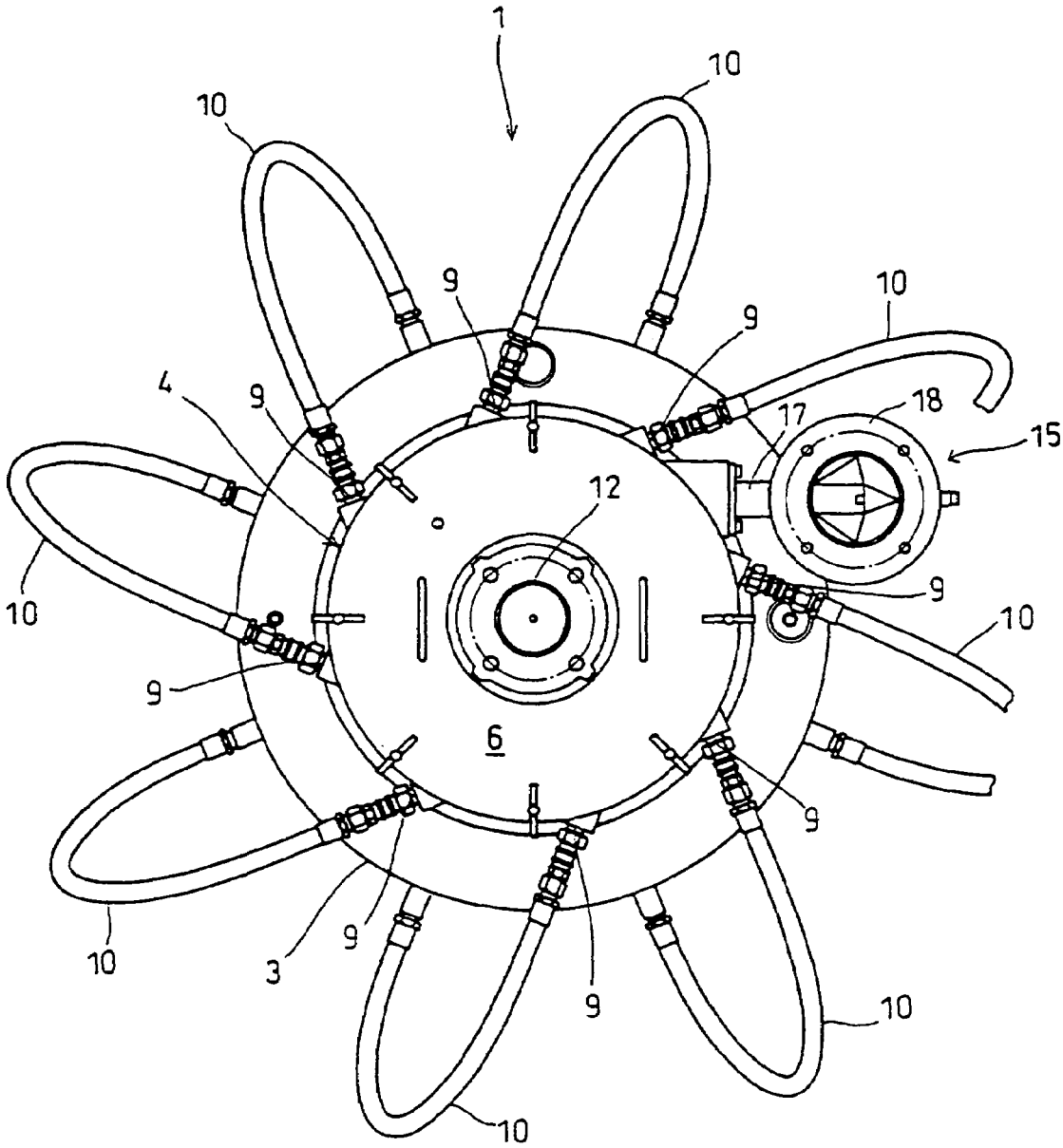
FIG. 2 is a plan view of the jet mill.
Figure 3:
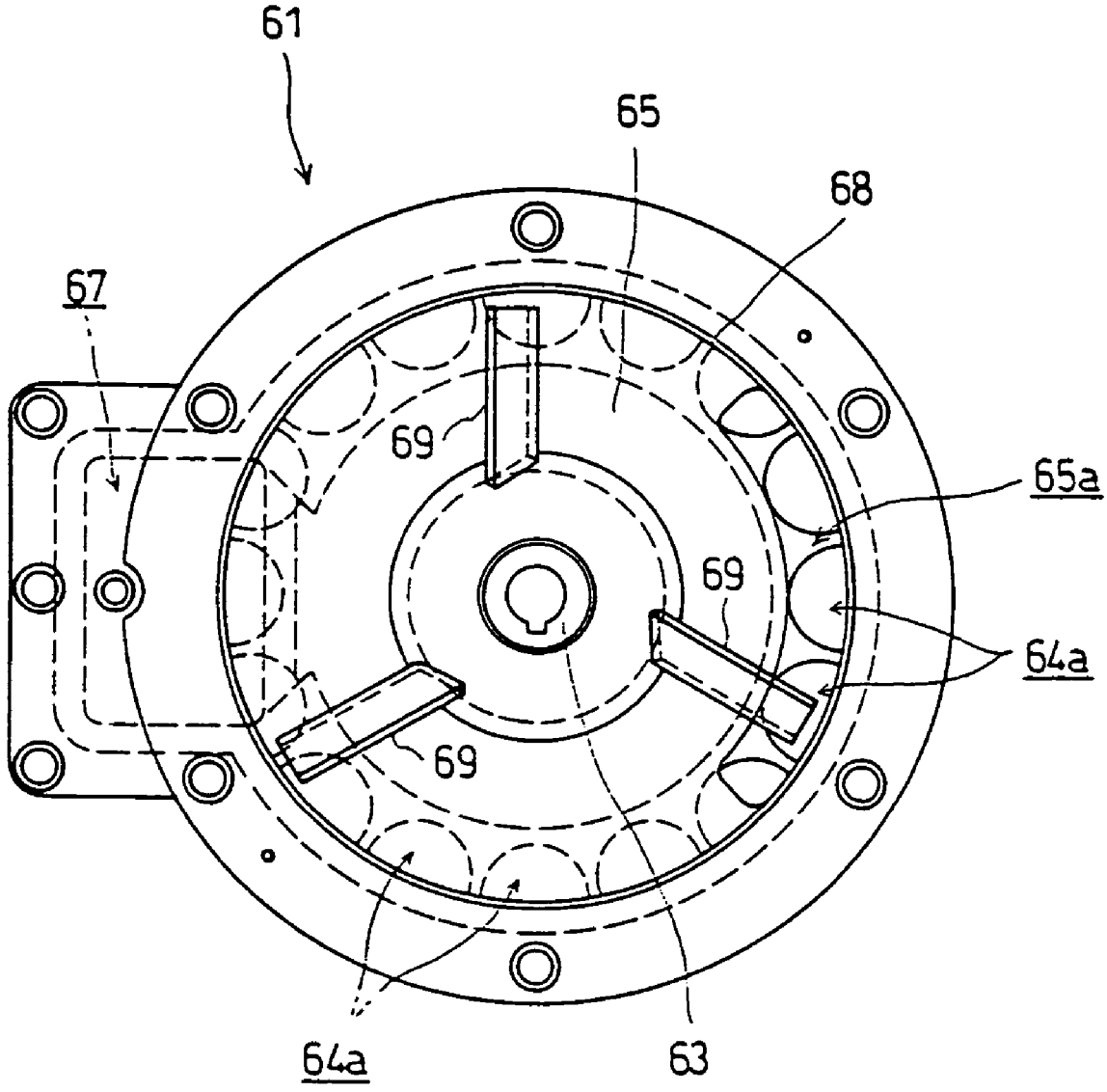
FIG. 3 is a sectional view taken on the line III-III in FIG. 1.

The construction of the jet mill 1 will be described with reference to FIG. 1 and FIG. 2 showing the jet mill 1 in plan view.

An annular ring header pipe 3 for storing compressed air is held on a middle part of a base 2, and an annular, flat, bottomed mill body 4 is held in a horizontal position on top of the base 2.

The mill body 4 is formed by covering the upper and the lower open end of a flat, cylindrical mill frame 5 with a disk-shaped upper plate 6 and a disk-shaped lower plate 7, respectively, and defines a swirling current chamber 8.

A plurality of pulverizing nozzles 9 (eight milling jet nozzles in this jet mill 1) are attached at equal angular intervals to the mill frame 5 forming a circumferential wall. The pulverizing nozzles are set in a horizontal plane so as to extend obliquely into the swirling current chamber 8.

The axis of each of the pulverizing nozzles 9 is inclined at an angle of about 45° to a tangent to the circular mill frame at the position of the pulverizing nozzle 9. The pulverizing nozzles 9 jet compressed air in equivalent directions into the swirling current chamber 8 to produce a swirling air current in the swirling current chamber 8.

Figure 4:
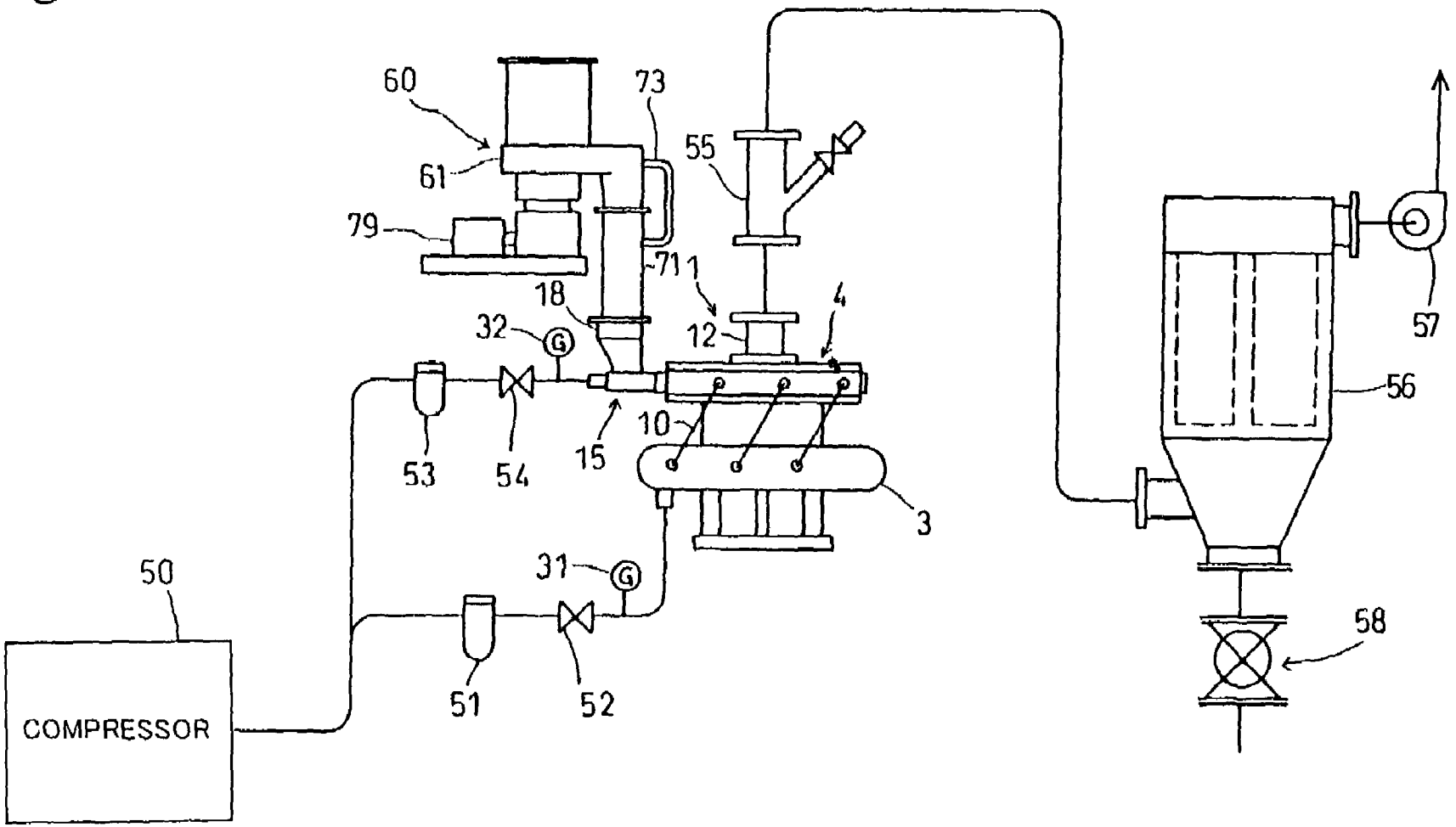
FIG. 4 is a schematic view of the jet mill shown in FIG. 1 and ancillary devices.

The pulverizing nozzles 9 are connected to the ring header pipe 3 by a plurality of connecting tubes 10, respectively. As shown in FIG. 4, a compressor 50 supplies compressed air through a pressure regulator 51 and a valve 52 to the ring header pipe 3. Compressed air is supplied through the connecting tubes 10 to the pulverizing nozzles 9, and compressed air is jetted through the pulverizing nozzles 9 into the swirling current chamber 8 to produce a swirling current.

A pressure gauge 31 is placed in a part between the ring header pipe 3 and the valve 52 in a line on the upstream side of the ring header pipe 3 to measure an initial pressure at the pulverizing nozzles 9.

An air injector 15 is attached to a part of the mill frame 5 between two adjacent pulverizing nozzles 9.

Referring to FIG. 1, the air injector 15 includes a pusher nozzle 16 disposed on the upstream side, a venturi nozzle 17 disposed on the downstream side coaxially with the pusher nozzle 16, and a feed hopper 18 disposed between the nozzles 16 and 17.

The venturi nozzle 17 is disposed between the two adjacent pulverizing nozzles 9 and is set, similarly to the pulverizing nozzles 9, in a horizontal plane so as to extend obliquely into the swirling current chamber 8.

As shown in FIG. 4, the compressor 50 is connected through a pressure regulator 53 and a valve 54 to the pusher nozzle 16 to supply compressed air to the pusher nozzle 16.

A pressure gauge 32 is placed in a part between the pusher nozzle 16 and the valve 54 in a line on the upstream side of the pusher nozzle to measure an initial pressure at the pusher nozzle 16.

Particle carrying air discharged through the pusher nozzle 16 is accelerated by the venturi nozzle 17 and the accelerated particle carrying air is ejected into the swirling current chamber 8. Thus, a vacuum is produced on the upstream side of the venturi nozzle 17 to suck particles fed by the particle feed apparatus 60 at a properly controlled feed rate into the feed hopper 18 to eject a solid-gas mixed fluid into the swirling current chamber 8.

As shown in FIG. 1, a cylindrical outlet extension pipe 11 is attached to a central part of the upper plate 6 with its axis vertically extended so as to project into the swirling current chamber 8. A cylindrical discharge case 12 is connected to the outlet extension pipe 11.

A substantially conical guide member 13 having an upward tapered central part is fixed to the inner surface of a central part of the lower plate 7 such that an upper end part of the central part thereof projects into the outlet extension pipe 11.

A swirling current is produced in the swirling current chamber 8 by ejecting compressed air through the plurality of pulverizing nozzles 9. Then the air injector 15 feeds particles together with carrying air into the swirling current chamber 8. Consequently, the swirling air current entrains the particles and the particles are crushed for fine pulverization by collision and abrasion between the particles, and collision and abrasion between the particles and the mill frame 5.

Centrifugal force acts on particles swirling together with the swirling air current and hence particles having greater particle sizes are distributed in regions further from the center of the swirling current chamber 8, and thereby particles are classified by particle size.

Fine particles included in the particles swirling together with the swirling air current gather in a central region of the swirling current chamber 8. Air being discharged from the swirling current chamber 8 entrains the fine particles, is guided by the guide member 13 and flows through the outlet extension pipe 11 into the discharge case 12. Thus, the fine particles are collected as a pulverized product.

The outlet extension pipe 11 is one of different outlet extension pipes having parts of different lengths that project into the swirling air current, and outlets of different diameters. A suitable outlet extension pipe is used selectively taking into consideration the amount of air flowing in a swirling air current.

High centrifugal forces act on coarse particles so that the coarse particles flow in peripheral parts of the swirling air current and successively undergo the actions of jets of compressed air ejected through the pulverizing nozzles 9. Thus, coarse particles are pulverized gradually.

The particle size of the fine particles produced by the jet mill 1 is adjusted by properly adjusting the velocity of the swirling air current swirling in the swirling current chamber. The higher the velocity of the swirling air current, the finer is the particle size of the fine particles.

Generally, the velocity of the swirling current is changed by a method that changes particle feed rate (kg/hr) or a method that changes the supply pressure of the compressed air supplied to the pulverizing nozzles 9.

The former method controls the velocity of the swirling current by fixing the bore diameter of the pulverizing nozzles 9 and keeping the pressure of the compressed air supplied to the pulverizing nozzles 9 constant and changing the particle feed rate (kg/hr) to change the solid-concentration of the solid-gas mixed fluid in the mill, which dominates load on the swirling current.

The solid concentration of the solid-gas mixed fluid increases and the jet mill produces a coarse pulverized product when the feed rate is high. The solid concentration of the solid-gas mixed fluid decreases and the jet mill produces a finely pulverized product when the feed rate is low.

The latter method controls the particle size of a pulverized product produced by the jet mill by fixing particle feed rate, and changes the pressure of the compressed air supplied to the pulverizing nozzles 9 to change the velocity of the swirling current in the swirling current chamber 8.

Air jetting rate ($m^3$/min) at which air is ejected through the pulverizing nozzles 9 increases, the velocity of the swirling current becomes high and particle are milled in a finely pulverized product when the supply pressure of the compressed air supplied to the pulverizing nozzles 9 is high.

Air jetting rate ($m^3$/min) at which air is jetted through the pulverizing nozzles 9 decreases, the velocity of the swirling current becomes low and particle are milled in a coarse pulverized product when the supply pressure of the compressed air supplied to the pulverizing nozzles 9 is low.

The particle feed apparatus 60 is connected to the air injector 15 of the jet mill 1. The particle feed apparatus 60 will be described with reference to FIGS. 1 and 3.

The particle feed apparatus 60 includes a table feeder 61, a particle hopper 72 disposed above the table feeder 61, and a connecting chute 71 connecting the table feeder 61 to the feed hopper 18 of the air injector 15.

The table feeder 61 includes a turntable 64, a vertical drive shaft 63 supporting the turntable 64 for turning, and a table case 62 accommodating the turntable 64. A plurality of pockets 64*a* of a semicircular shape in a plane are formed in a thick peripheral part of the turntable 64. The pockets 64*a* are separated from each other by partition plates, respectively.

The turntable 64 is sandwiched between an upper plate 65 and a lower plate 66. An arcuate opening 65*a* is formed in the upper plate 65 so as to correspond to the pockets 64*a*. A cutout 66*a* is formed in the lower plate 66 so as to correspond to the pockets 64*a*. The arcuate opening 65*a* and the cutout are diametrically opposite to each other. An exit chute 67 is connected to the cutout 66*a*, and the open upper end of the connecting chute 71 is connected to the exit chute 67.

The particle hopper 72 is connected to the upper plate 65 by a cylindrical connecting case 68.

A carrying blade 69 extends from the drive shaft 63 and turns along the upper plate 65 in the cylindrical case 68. A stirring blade 70 extending from the drive shaft 63 turns along a bottom plate 72*a* provided with a delivery opening in the particle hopper 72.

The drive shaft 63 extends through the lower plate 66 placed in the table case 62, and is supported for rotation relative to the lower plate via a sealing member 76 and a bearing 77. A gear mechanism 78 interlocks a lower end part of the drive shaft 63 with a motor 79 (FIG. 4). The motor 79 drives the drive shaft 63 for rotation through the gear mechanism 78.

An equalizer pipe 73 has one end connected to a connecting pipe 72*b* laterally projecting from an upper part of the cylindrical particle hopper 72 and the other end connected to a connecting pipe 71*a* projecting from the connecting chute 71.

The open upper end of the particle hopper 72 is covered with a hatch 74.

A safety valve 75 is placed in a small pipe 72*c* projecting from an upper part of the sidewall of the particle hopper 72.

In the particle feed apparatus 60, the particle hopper 72 closed by the hatch 74, the cylindrical connecting case 68, the table case 62, the exit chute 67 and the connecting chute 71 are connected in an airtight fashion to form a closed structure. The connecting chute 71 is connected hermetically to the feed hopper 18.

The equalizer pipe 73 simply connects the respective interiors of the particle hopper 72 and the connecting chute 71 and is isolated from the environment.

Thus, the particle feed apparatus 60 is a closed structure having an internal space connected to the feed hopper 18 of the air injector 15 and isolated from the environment.

Particles supplied into the particle hopper 72 stirred by the stirring blade 70, fall into the cylindrical connecting case 68, are shoved so as to fall through the circular opening 65*a* into the pockets 64*a* of the turning turntable 64 to fill up the pockets 64*a* with a predetermined amount of particles. The predetermined amount of particles contained in each of the pockets 64*a* falls through the opening 66*a* of the lower plate 66 into the exit chute 67 and is fed through the connecting chute 71 into the feed hopper 18 of the air injector 15.

Since the particle feed rate increases with the increase of the turning speed of the turntable 64, the particle feed rate can be adjusted by controlling the operating speed of the motor 79.

The hatch 74 of the particle hopper 72 is kept closed while the particle feed apparatus 60 is in operation to feed particles in a closed structure.

The performance of a closed milling system formed by connecting the jet mill 1 and the closed particle feed apparatus 60 was tested. As shown in FIG. 4, a sampling pipe 55 was connected to the discharge case 12 of the jet mill 1, a bag filter 56 was connected to the sampling pipe 55 to collect a pulverized product produced by milling, and a small sampling bag, not shown, was connected to a branch pipe of the sampling pipe 55.

Sample pulverized products were collected by the sampling bag. A blower 57 was connected to the bag filter 56. A pulverized product can be recovered through a rotary valve 58.

Kaolin particles of 8.24 μm in mean particle size were used as test particles.

When the closed particle feed apparatus 60 is used, the supply pressures of compressed air supplied to the pusher nozzle 16 and the pulverizing nozzles 9 can optionally be determined regardless of feed rate. Therefore, supply pressure of compressed air supplied to the pusher nozzle 16 and the pulverizing nozzle 9 was fixed at 0.6 MPa (gage pressure), and the particles were fed at feed rates of 0.8, 2.2, 4.5, 9.0, 17.8 and 21.7 kg/hr for milling tests.

Particles were supplied into the particle hopper 72, the hatch 74 was closed to close the particle feed apparatus 60, and compressed air was supplied at the supply pressure of 0.6 MPa to the pusher nozzle 16 and the pulverizing nozzles 9.

Since any backflow does not occur when the closed particle feed apparatus 60 is used, the valves 52 and 54 can be opened at a stretch and the operation of the valves 52 and 54 is very simple.

The table feeder 61 provided with the partition walls was operated to feed the particles at feed rates of 0.8, 2.2, 4.5, 9.0, 17.8 and 21.7 kg/hr, and the particles were milled. Pulverized products thus produced were sampled through the sampling pipe 55. Particle sizes of sample pulverized products were measured and mean particle sizes of the sample pulverized products were calculated. Static pressure in the equalizer pipe 73 was measured while the particles are fed at each of the foregoing feed rates.

Measured test results are shown in FIG. 5A.

As obvious from FIG. 5A, the particles were finely pulverized at all the feed rates, and the mean particle sizes of the sample pulverized products were small as compared with those of sample pulverized products obtained by milling particles by an open milling system. Particularly, the mean particle size of the sample pulverized product was as small as 3.48 μm when the feed rate was 0.8 kg/hr, because the particle concentration of the swirling current swirling in the jet mill 1 was small, the load on the swirling current was small, the velocity of the whirling current was high and, consequently, the milling ability of the jet mill 1 was high.

All the static pressures (gauge pressure, i.e., the pressure by which the total absolute pressure exceeds the atmospheric pressure) in the equalizer pipe 73 are positive pressures as shown in the table shown in FIG. 5A, and hence backflow will occur if the equalizer pipe 73 is opened.

In the test milling operations of the closed milling system under all the conditions including those different feed rates, backflow did not occur at all, the particles could be satisfactorily pulverized, and the pulverized products could be smoothly recovered.

Figure 11:
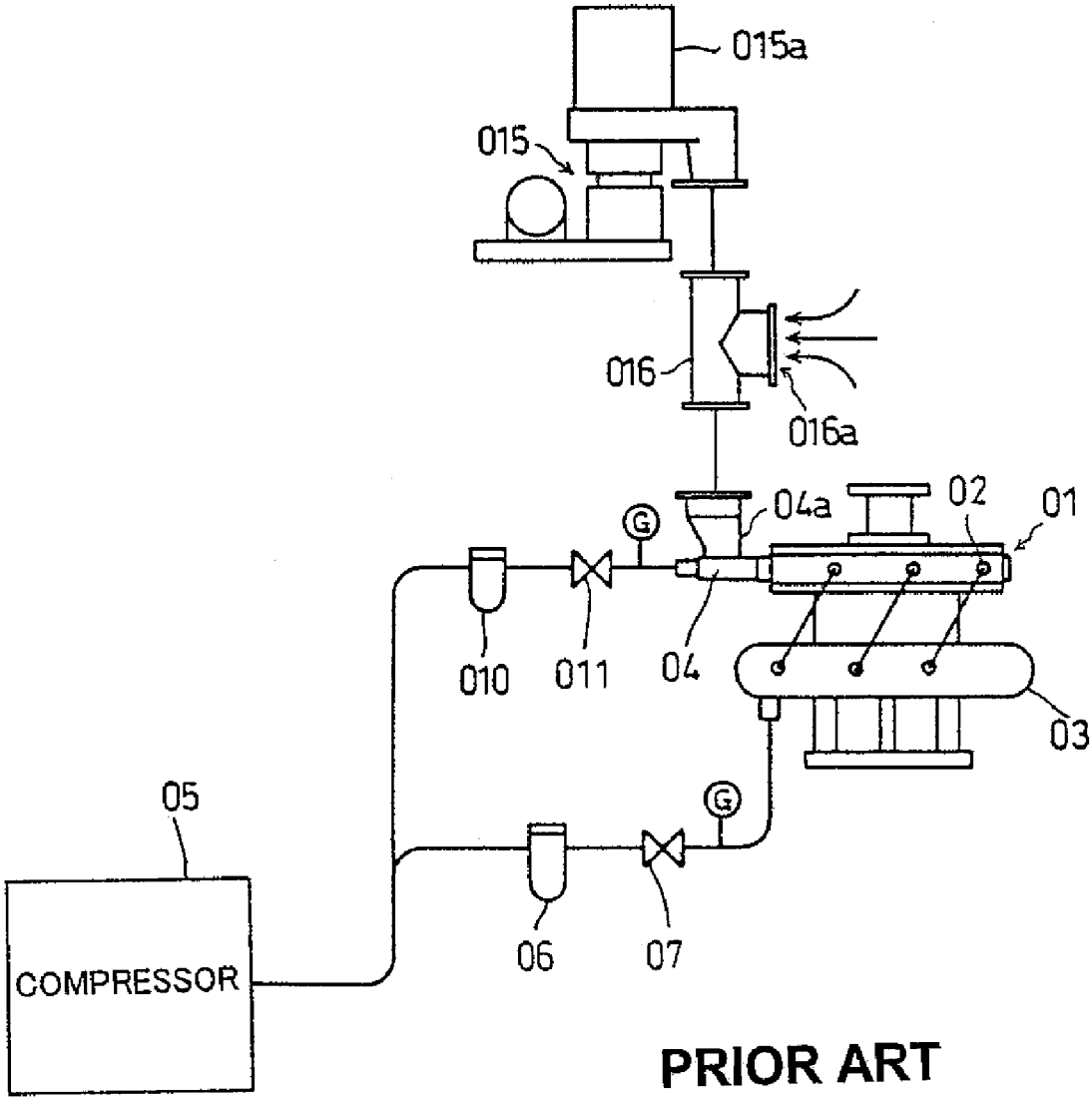
FIG. 11 is a view of a jet mill combined with a conventional particle feed apparatus.

FIG. 5B shows the results of test operations of an open milling system formed by combining a conventional open particle feed apparatus shown in FIG. 11 and the same jet mill 1.

The test operations will be described in connection with FIG. 11.

Kaolin particles of 8.24 μm in mean particle size were used as test particles.

The air injector 04 was actuated by supplying compressed air of 0.6 MPa to the pusher nozzle, and then compressed air of 0.3 MPa was supplied to the pulverizing nozzles 02 to produce a swirling current in the mill.

The pressure of 0.3 MPa of compressed air supplied to the pulverizing nozzles 02 was a supply pressure that made the jet mill 01 to suck secondary air slightly through the opening 016*a* of the connecting chute 016 and enabled the jet mill 01 to operate without causing backflow.

The particles were fed at feed rates of 0.8, 2.2, 4.5, 9.0, 17.8 and 21.7 kg/hr for milling tests by the feeder 015, and the valve 07 was opened gradually to supply compressed air to the pulverizing nozzles 02.

The valve 07 was further opened so carefully that the backflow of the particles may not occur. The operation for opening the valve 07 was stopped upon the opening of the valve 07 in a degree slightly smaller than that in which the backflow of the particles will occur.

Such an operation of the valve 07 was repeated until a stable swirling current having a fixed particle holdup is produced in the jet mill 01, and the valve 07 was fixed. FIG. 5B shows supply pressures of compressed air supplied to the pulverizing nozzles 02 in such a state.

The supply pressures shown in FIG. 5B are slightly lower than those at which backflow will start.

Pulverized products produced by milling the particles supplied at those feed rates were sampled to obtain sample pulverized products. Mean particle sizes of the sample pulverized products were determined. FIG. 5B shows those mean particle sizes.

Figure 6:
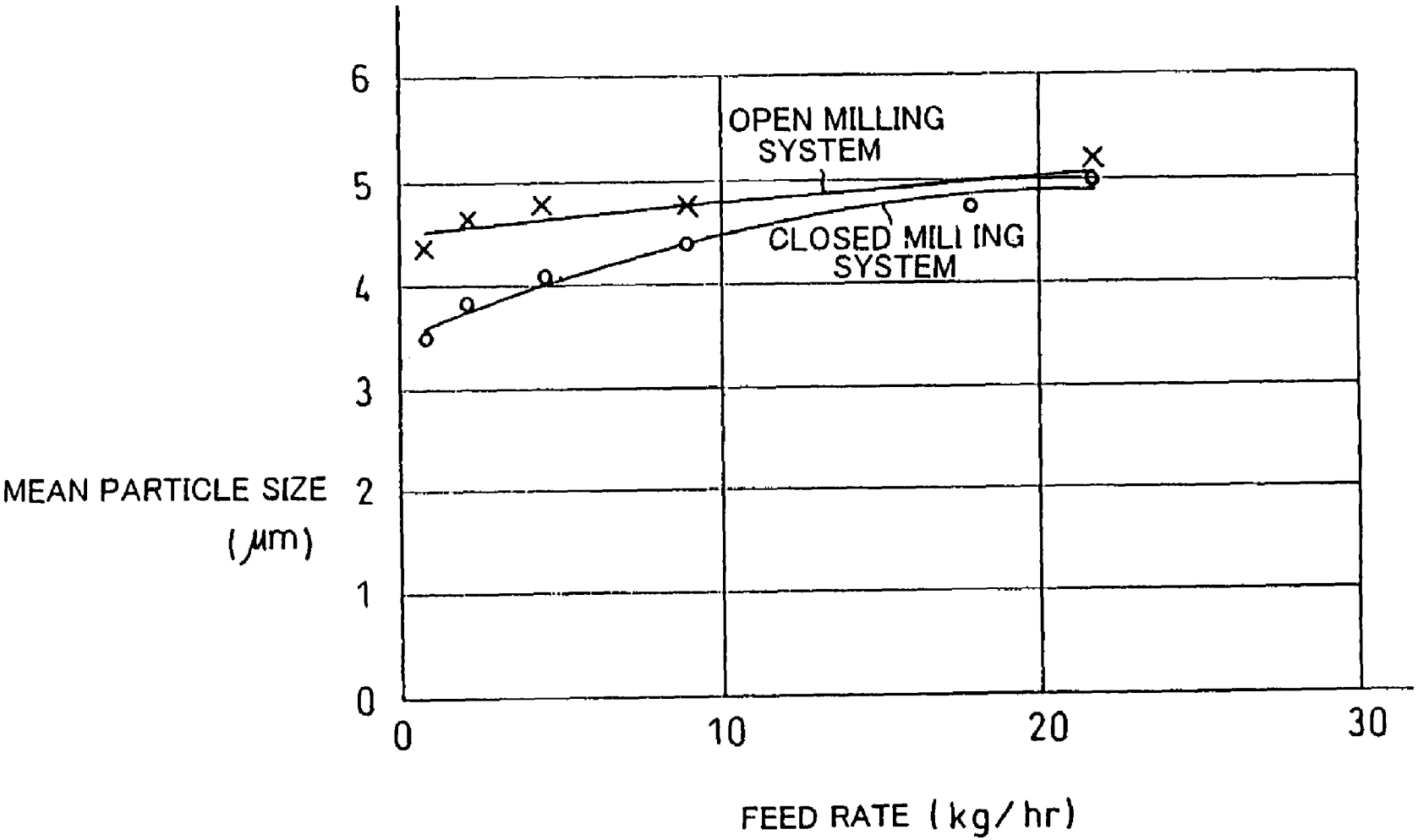
FIG. 6 is a graph showing the test results shown in FIGS. 5A and 5B.

FIG. 6 is a graph comparatively showing the mean particle sizes of the pulverized products produced by the closed milling system employing the closed particle feed apparatus 60 of the present invention (FIG. 5A), and those of the pulverized products produced by the open milling system employing the conventional open particle feed apparatus (FIG. 5B).

The mean particle sizes of the pulverized products produced by the closed milling system employing the closed particle feed apparatus 60 of the present invention were smaller than those of the pulverized products produced by the open milling system employing the conventional open particle feed apparatus at all the feed rates.

Backflow occurs in the open milling system employing the conventional open particle feed apparatus if the supply pressure of compressed air supplied to the pulverizing nozzles 02 is increased beyond the pressures shown in the table shown in FIG. 5B. Therefore the velocity of the swirling current cannot be increased and hence the milling ability cannot be enhanced beyond the level shown in FIG. 5B.

Comparative tests of noise generated by the closed milling system employing the closed particle feed apparatus 60 of the present invention, and the open milling system employing the conventional open particle feed apparatus during milling operation were performed in addition to the comparative tests of milling ability.

Noise levels of sound generated while any particles were not fed to the jet mills and while particles were fed to the jet mills were measured at two positions, at distances of 1 m and 3 m, respectively, from the center of the jet mill with a sound level meter.

Measured noise levels are shown in FIGS. 7A and 7B. FIG. 7A shows measured noise levels of sound generated when any particles were not fed to the jet-mills, and FIG. 7B shows measured noise levels of sound generated when particles were fed to the jet mills.

As obvious from FIGS. 7A and 7B, noise levels of sound generated by the closed milling system employing the closed particle feed apparatus 60 of the present invention both when any particles were not fed to the jet mill and when particles were fed to the jet mill are very low as compared with those of sound generated by the open milling system employing the conventional open particle feed apparatus under the corresponding conditions. Thus, the closed milling system employing the closed particle feed apparatus 60 of the present invention greatly improves the working environment.

The table feeder 61 of the particle feed apparatus 60 of the present invention fills up the pockets 64*a* of the turntable 64 with the particles, and the particles contained in the pockets 64*a* are dropped through the exit chute 67. Normally, the particles cannot flow into the exit chute 67 while the turntable 64 is at a standstill because an upper particle feed space on the upstream side of the turntable 64 and a lower particle feed space on the downstream side of the turntable 64 are thus separated from each other.

However, if gaps are formed between the turntable 64 and the inner side surface of the table case 62, between the turntable 64 and the upper plate 65 and between the turntable 64 and the lower plate 66, and the particles are free-flowing materials, it is possible that the particles start flowing spontaneously when the pressure in the lower particle feed space drops below that in the upper particle feed space.

Air held between the particles tends to diffuse outside when particles kept in the atmosphere are loaded into the closed milling system at a reduced pressure, and hence the particles flow more easily in the closed milling system than in the atmosphere.

In this embodiment, the interior of the particle hopper 72 and that of the connecting chute 71 are connected by the equalizer pipe 73 to suppress the flow of the particles in the closed particle feed apparatus. Since the pressures in the upper and the lower particle feed space are equalized by the equalizer pipe 72, the spontaneous flow of the particles can be avoided even if a negative pressure is produced in the air injector 15 on the downstream side.

Although the spontaneous flow of almost all kinds of particles can be avoided because the upper and the lower particle feed space are separated by the table feeder 61, the equalizer pipe 73 prevents the spontaneous flow of particles substantially perfectly.

When the closed particle feed apparatus 60 of the present invention is thus used in combination with the jet mill 1, the backflow of particles and air does not occur at all from the start to the end of the milling operation. Consequently, the scattering of particles and powder in the space around the jet mill 1 can be avoided and a working environment desirable for the health management of operators can be created.

Although the milling of poisonous substances and radioactive substances, such as uranium and plutonium, has been disliked, the particle feed apparatus of the present invention capable of preventing the solid-gas mixed fluid from particles from spreading in the working environment expands the field of materials that can be safely milled by the jet mill.

The valves of the conventional open milling system need to be operated by many sequential steps to prevent backflow depending on the operator's experience. The use of the closed particle feed apparatus of the present invention simplifies the operation, enables any operator to operate the valve and facilitates the milling work greatly. The milling operation can be automated.

When the conventional open particle feed apparatus is used, the jet mill can be operated only under a condition where the static pressure of the swirling current produced in the jet mill does not exceed the vacuum of the air injector to operate the jet mill without causing backflow. Therefore, there is a limit to the supply pressure of compressed air supplied to the pulverizing nozzles and hence fine pulverization cannot be achieved by using a high-velocity swirling current. The closed particle feed apparatus 60 of the present invention is able to feed particles at a low feed rate while compressed air of a high supply pressure is supplied to the pulverizing nozzles 9. Consequently, particles can be pulverized in the high-velocity swirling current for fine pulverization that could not have been achieved by using the conventional open particle feed apparatus.

Although the particle feed apparatus in this embodiment is provided with the table feeder 61 provided with the partition plates, the particle feed apparatus may be provided with a feeder other than the table feeder 61, such as a generally known scraper-type table feeder.

Figure 8:
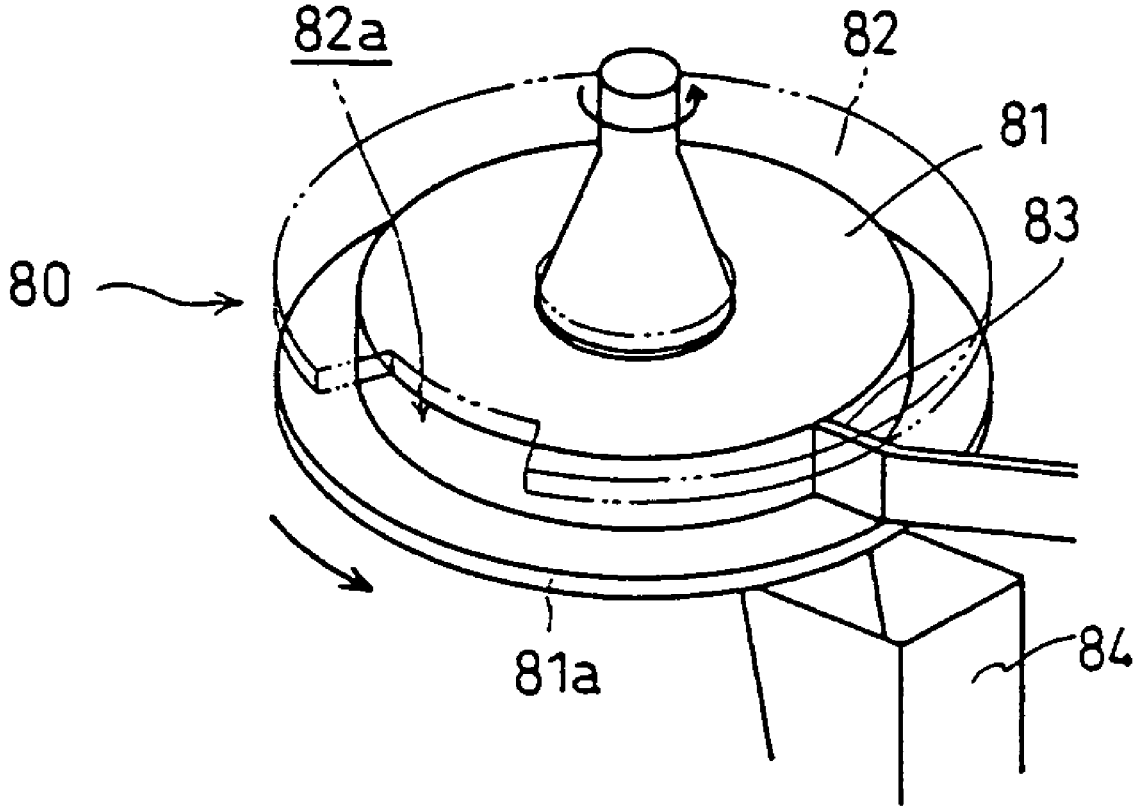
FIG. 8 is a perspective view of a turntable included in a scraper-type table feeder.

As shown in FIG. 8, a scraper type turntable feeder 80 is provided with a turntable 81 instead of the turntable 64 of the table feeder 61 provided with partition plates. The turntable 81 is provided with a lower flange 81*a* serving as a lower plate.

An upper plate 82 is provided with a circular recess 82*a*. Particles fall through the circular recess 82*a* onto the lower flange 81*a* in a heap, the heap of the particles is cut by the edges of the circular opening 82*a* to hold a measured amount of particles on the lower flange 81*a*, and the measured amount of particles are scraped off into an exit chute 84 by a scraper 83.

This scraper type table feeder does not separate an upper feed space on the upstream side and the exit chute 84 in a lower feed space on the downstream side. Therefore, particles are continuous from the upper feed space through the circular recess 82*a* and the lower flange 81*a* to the exit chute 84.

Thus, it is possible that free-flowing particles flow spontaneously even while the turntable 81 is at a standstill. The fluidity of the particles is enhanced and the particles become more likely to flow when the pressure in the upper feed space and that in the lower feed space are different from each other and a negative pressure is produced in the lower feed space.

Thus, the use of an equalizer pipe is particularly important when the particle feed apparatus is provided with the scraper-type table feeder 80.

The particle feed apparatus may be provided with an electromagnetic feeder.

Figure 9:
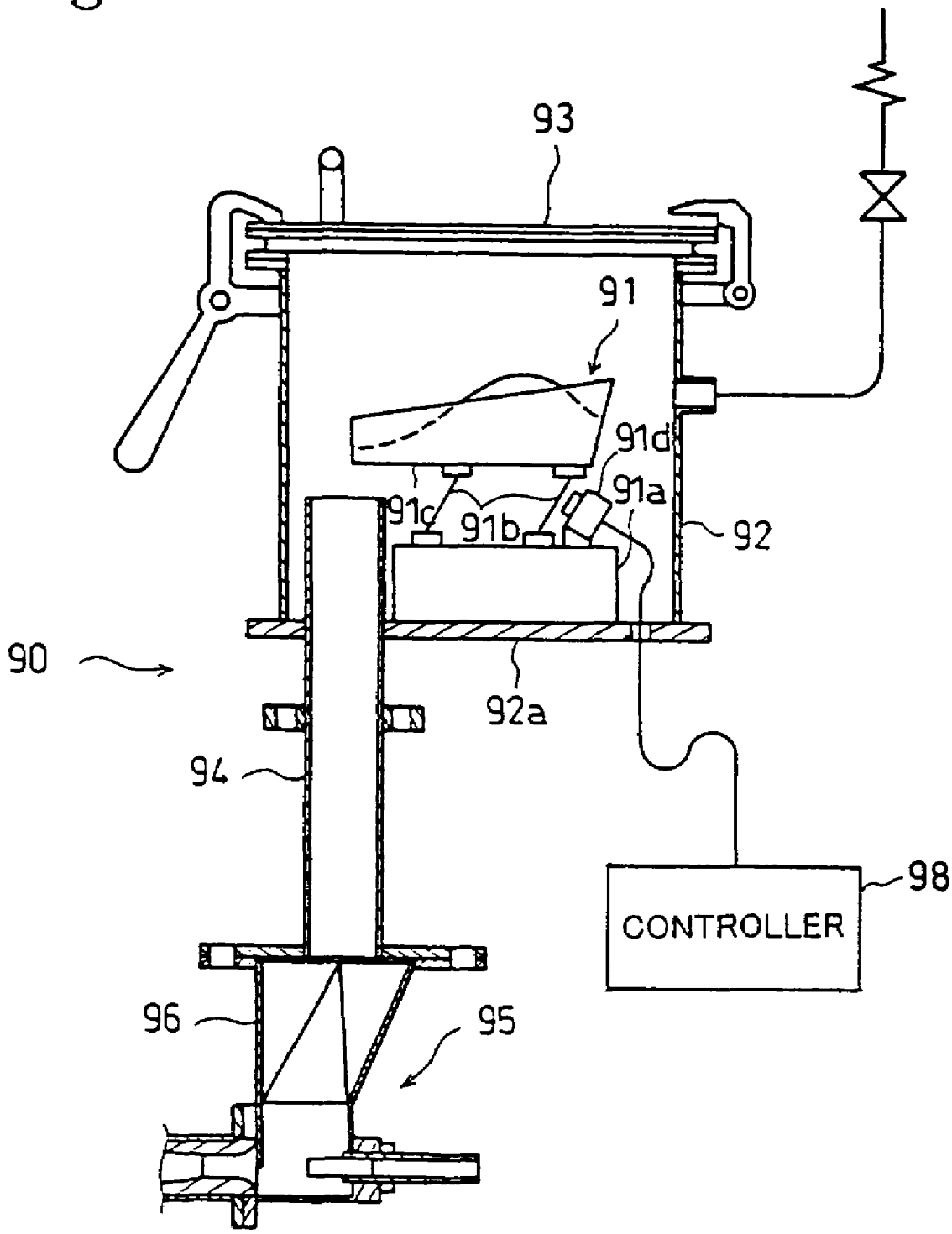
FIG. 9 is a sectional view of a sectional view of a particle feed apparatus including an electromagnetic feeder.
Figure 10:
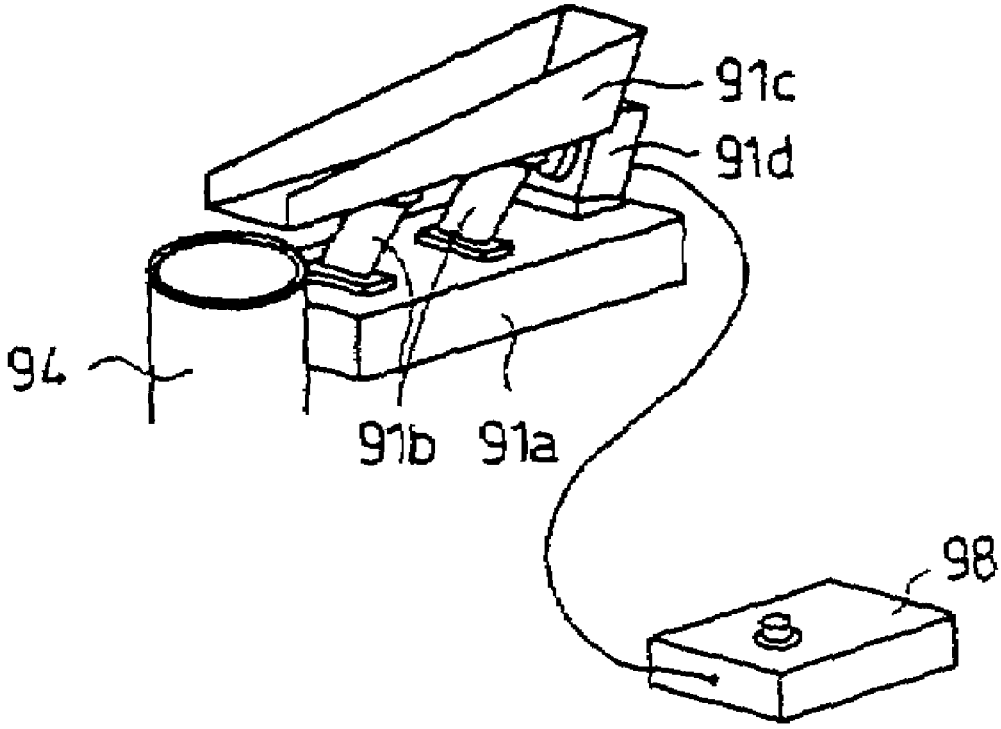
FIG. 10 is a perspective view of the electromagnetic feeder shown in FIG. 9.

FIG. 9 shows a particle feed apparatus 90 provided with an electromagnetic feeder 91 in a sectional view, and FIG. 10 is a perspective view of the electromagnetic feeder 91.

The electromagnetic feeder 91 is contained in a closed vessel 92 having an open upper end closed by a hatch 93 that can be opened. A closed connecting chute 94 penetrates the bottom wall 92*a* of the closed vessel 92 and the gap between the closed connecting chute 94 and the bottom wall 92*a* is sealed. The electromagnetic feeder 92 pours particles into the open upper end of the closed connecting chute 94.

The closed connecting chute 94 has an open lower end hermetically joined to a feed hopper 96 included in the air injector 95 of a jet mill.

In this particle feed apparatus 90, the closed vessel 92 and the closed connecting chute 94 connected to the feed hopper 96 constitute a closed structure isolated from the environment, and the electromagnetic feeder 91 is contained in the closed vessel 92.

The electromagnetic feeder 91 has a trough 91*c* supported on support legs 91*b* obliquely set on a base 91*a*. An electromagnet 91*d* acts on the support legs 91*b*. A controller 98 controls the electromagnet 91*d*.

The trough 91*c* is a transversely elongate box having one open end serving as an exit. Particles are held on the trough 91*c*. The electromagnet 91*d* vibrates the trough 91*c* laterally to feed the particles through the exit into the closed connecting chute 94 at a fixed feed rate.

Since the particle feed apparatus 90 also is of a closed type, backflow due to the static pressure of the swirling current produced in the mill can be prevented.

The particle feed apparatus 90 provided with the electromagnetic feeder 91 is suitable for use in milling a comparatively small amount of particles and particularly suitable for use in milling particles having low adhesive property.

INDUSTRIAL APPLICABILITY

Although the present invention has been described as applied to a horizontal swirling-current jet mill, the present invention is applicable to jet mills of other types, and to particle-processing machines other than milling machines, such as classifiers.

Although there have been described what are the present embodiments of the invention, it will be understood that variations and modifications may be made thereto without departing from the spirit of essence of the invention. The scope of the invention is indicated by the appended claims.

The invention claimed is:

1. A particle feed apparatus for feeding particles to a jet mill, said particle feed apparatus comprising a particle hopper, a particle feeder for feeding particles contained in the particle hopper, and a connecting chute connecting the particle feeder to an air injector of a jet mill to feed particles into the air injector; wherein the particle hopper, the particle feeder and the connecting chute are assembled to form a closed structure and define closed spaces connected to the interior of the air injector and isolated from the environment, respectively, and wherein an equalizer pipe is provided to connect an upper portion of the interior of the particle hopper and a downstream portion of the interior of the particle feeder, whereby the particles are supplied into the jet mill solely by supplying compressed air to the air injector.

2. The particle feed apparatus according to claim 1, wherein the particle feeder is a rotary feed mechanism provided with partition plates.

3. The particle feed apparatus according to claim 2, wherein the rotary feed mechanism provided with partition plates includes: a turntable provided in its peripheral part with a plurality of particle feed pockets separated from each other, a turntable case accommodating the turntable, and a rotative drive shaft for driving the turntable for rotation.

4. The particle feed apparatus according to claim 3, wherein the turntable is disposed between an upper plate and a lower plate so as to rotate in sliding contact with the upper and the lower plates, the upper and the lower plates are provided in their peripheral parts with a cutout serving as a particle inlet and a cutout serving as a particle outlet, respectively, and the cutouts are at vertically non-coinciding positions.

5. The particle feed apparatus according to claim 1, wherein, the air injector is provided with a feed hopper, and the connecting chute is connected in an airtight fashion to the feed hopper.

6. The particle feed apparatus according to claim 1, wherein the particle hopper is provided with a normally closed hatch.

7. The particle feed apparatus according to claim 1, further comprising a mechanism which maintains a pressure in the interior of said particle feed apparatus equal to a remainder of subtraction of a vacuum in the air injector from a static pressure in the jet mill during operation.

8. The particle feed apparatus according to claim 1, wherein the rotary feeder is provided with partition plates and includes: a turntable provided in its peripheral part with a plurality of particle feed pockets separated from each other, a turntable case accommodating the turntable, and a rotative drive shaft for driving the turntable for rotation.

9. The particle feed apparatus according to claim 8, wherein the turntable is disposed between an upper plate and a lower plate so as to rotate in sliding contact with the upper and the lower plates, the upper and the lower plates are provided in their peripheral parts with a cutout serving as a particle inlet and a cutout serving as a particle outlet, respectively, and the cutouts are at vertically non-coinciding positions.

10. The particle feed apparatus according to claim 1, wherein the particle hopper is provided with a normally closed hatch.

* * * * *

UNITED STATES PATENT AND TRADEMARK OFFICE

CERTIFICATE OF CORRECTION

PATENT NO. : 7,278,595 B2
APPLICATION NO. : 10/478605
DATED : October 9, 2007
INVENTOR(S) : Itoh et al.

It is certified that error appears in the above-identified patent and that said Letters Patent is hereby corrected as shown below:

In the drawings:

Fig. 5B, for the MEAN PARTICLE SIZE corresponding to FEED RATE 2.2 kg/hr, change "4.,54" to --4.54--.

Column 1:

Lines 43-44, change "a solid-gas mixed fluid containing carrying air and particles into the horizontal" to --a solid-gas mixed fluid, containing carrying air and particles, into the horizontal--.

Column 2:

Line 13, change "swirling-current" to --swirling current--.

Line 19, change "Therefore the jet mill" to --Therefore, the jet mill--.

Lines 54-55, change "swirling current having a fixed particle holdup is produced" to --swirling current, having a fixed particle holdup, is produced--.

Column 3:

Line 14, change "air injector, and hence the jet" to --air injector and, hence, the jet--.

Line 32, after "the operator's experience" insert a period.

Line 59, change "if there is any indications" to --if there is any indication--.

Column 4:

Line 19, change "and it is therefore an object to" to --and it is, therefore, an object--.

Line 29, change "apparatus according to" to --apparatus, according to--.

Line 30, change "present invention for" to --present invention, for--; after "jet mill comprises" insert a colon.

Line 45, change "apparatus according to" to --apparatus, according to--.

Line 46, change "present invention for" to --present invention, for--.

Column 5:

Line 7, change "are equalized and" to --are equalized, and--.

Line 14, change "standstill and thereby" to --standstill, and thereby--.

Line 26, change "lower plate, the upper and the lower" to --lower plate. The upper and the lower--.

Line 41, change "is partly sectional view" to --is a partly sectional view--.

Line 50, change "a the milling" to --the milling--.

Line 62, change "is a sectional view of a sectional view of a particle" to --is a sectional view of a particle--.

UNITED STATES PATENT AND TRADEMARK OFFICE

CERTIFICATE OF CORRECTION

PATENT NO. : 7,278,595 B2
APPLICATION NO. : 10/478605
DATED : October 9, 2007
INVENTOR(S) : Itoh et al.

It is certified that error appears in the above-identified patent and that said Letters Patent is hereby corrected as shown below:

Column 6:

Lines 14-15, change "and an annular, flat, bottomed mill body" to --and an annular, flat-bottomed mill body--.

Line 24, change "and hence particles" to --and, hence, particles--.

Line 25, change "in regions further from the" to --in regions farther from the--.

Line 28, change "frame at the position" to --frame 5 at the position--.

Line 59, change "solid-concentra-" to --solid concentra- --.

Column 8:

Line 8, change "particle are milled" to --particles are milled--.

Line 13, change "particle are milled" to --particles are milled--.

Column 9:

Line 7, change "hopper 72 stirred" to --hopper 72 are stirred--.

Line 9, change "are shoved" to --then are shoved--.

Line 42, change "pulverizing nozzle 9" to --pulverizing nozzles 9--.

Column 10:

Line 6, change "velocity of the whirling current" to --velocity of the swirling current--.

Line 32, change "jet mill 01 to suck" to --jet mill 01 suck--.

Column 11:

Line 7, change "Therefore the velocity" to --Therefore, the velocity--.

Line 15, change "milling operation were performed" to --milling operation, were performed--.

Line 24, change "to the jet-mills" to --to the jet mills--.

Column 12:

Line 46, change "a scraper type" to --a scraper-type--.

Line 56, change "amount of particles are" to --amount of particles is--.

Line 58, change "This scraper type" to --This scraper-type--.

UNITED STATES PATENT AND TRADEMARK OFFICE

CERTIFICATE OF CORRECTION

PATENT NO. : 7,278,595 B2
APPLICATION NO. : 10/478605
DATED : October 9, 2007
INVENTOR(S) : Itoh et al.

It is certified that error appears in the above-identified patent and that said Letters Patent is hereby corrected as shown below:

Column 13:

Line 54, change "the spirit of essence" to --the spirit or essence--.

Signed and Sealed this

Eighth Day of April, 2008

JON W. DUDAS
*Director of the United States Patent and Trademark Office*